US010998151B2

(12) United States Patent
Inaba

(10) Patent No.: US 10,998,151 B2
(45) Date of Patent: May 4, 2021

(54) PUSH BUTTON FOR USE WITHIN A TIMEPIECE

(71) Applicant: CASIO COMPUTER CO., LTD., Tokyo (JP)

(72) Inventor: Tomohiro Inaba, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/718,539

(22) Filed: Dec. 18, 2019

(65) Prior Publication Data

US 2020/0203096 A1 Jun. 25, 2020

(30) Foreign Application Priority Data

Dec. 19, 2018 (JP) ..... JP2018-237255

(51) Int. Cl.
*H01H 13/14* (2006.01)
*H01H 13/52* (2006.01)

(52) U.S. Cl.
CPC ..... *H01H 13/14* (2013.01); *H01H 13/52* (2013.01); *H01H 2205/032* (2013.01); *H01H 2231/028* (2013.01)

(58) Field of Classification Search
CPC ..... G04B 3/001; G04B 3/046; G04B 3/048; H01H 13/14; H01H 13/50; H01H 13/52; H01H 2013/525; H01H 2231/028; H01H 2237/004; H01H 2300/016; H01H 2221/064; G04G 21/00
See application file for complete search history.

(56) References Cited

U.S. PATENT DOCUMENTS 5,644,553 A * 7/1997 Cuinet ..... G04B 19/30 368/190

FOREIGN PATENT DOCUMENTS

| | | | | |
|---|---|---|---|---|
| FR | 2753832 A1 * | 3/1998 | ..... | H01H 13/52 |
| JP | H05-028877 A | 2/1993 | | |
| JP | H06-005062 U | 1/1994 | | |
| JP | 2007-305385 A | 11/2007 | | |
| JP | 2017-053636 A | 3/2017 | | |

* cited by examiner

*Primary Examiner* — Vanessa Girardi
(74) *Attorney, Agent, or Firm* — Scully Scott Murphy & Presser

(57) ABSTRACT

Disclosed is a push button including: a module that has a fixed contact part which is able to contact and separate from a movable contact part; an elastically deformable dynamic contact member that is supported in a cantilever state with a base part fixed to the module, and that has the movable contact part electrically contactable with the fixed contact part; and an operation receiving member that makes the movable contact part contact the fixed contact part by having one end acting on an acting portion. The movable contact part is arranged out of (i) a line connecting the acting portion and the base part and (ii) an extended line thereof, the dynamic contact member has a first movable part and a second movable part, the acting portion is arranged in the first movable part, and the movable contact part is arranged in the second movable part.

10 Claims, 5 Drawing Sheets

PUSH BUTTON FOR USE WITHIN A TIMEPIECE

CROSS-REFERENCE TO RELATED APPLICATION

This application is based upon and claims the benefit of priority from the prior Japanese Patent Application No. 2018-237255, filed on Dec. 19, 2018, the entire contents of which are incorporated herein by reference.

BACKGROUND

Technical Field

The technical field of the present application relates to a push button and a timepiece.

Background Art

For example, as disclosed in JP 2007-305385A of the patent application which was filed in Japan, there is known a push button configured to push a contact spring, which is provided with a contact part, with an operating member and thereby make the contact part electrically contact a contact part which is provided on a circuit board, to perform switching.

The push button having such a configuration is used as a switch for electronic equipment such as a timepiece, for example.

However, in a case where the operating member of the push button strongly acts on the contact spring due to the operating member being strongly pushed, colliding with something, or the like, the contact part which is arranged in the contact spring strongly contacts the contact part which is provided on the circuit board, and thus the contact part itself and the circuit board on which the contact part is provided are damaged.

Furthermore, not only the damage of the push button occurs, there may occur various types of troubles such as damages of parts forming the electronic equipment such as a timepiece into which the push button is incorporated.

SUMMARY

The present embodiment discloses a push button and a timepiece.

A push button in the present embodiment includes: a module that has a fixed contact part which is able to contact and separate from a movable contact part; a dynamic contact member that is supported in a cantilever state with a base part fixed to the module, that has the movable contact part which is electrically contactable with the fixed contact part, and that is elastically deformable; and an operation receiving member that makes the movable contact part contact the fixed contact part by having one end of the operation receiving member acting on an acting portion of the dynamic contact member, wherein the movable contact part in the dynamic contact member is arranged at a position out of (i) a line connecting the acting portion and the base part and (ii) an extended line of the line, the dynamic contact member has a first movable part and a second movable part, the acting portion is arranged in the first movable part, and the movable contact part is arranged in the second movable part.

BRIEF DESCRIPTION OF THE DRAWINGS

The accompanying drawings are not intended as a definition of the limits of the invention but illustrate embodiments of the invention, and together with the general description given above and the detailed description of the embodiments given below, serve to explain the principles of the invention, wherein.

DESCRIPTION OF EMBODIMENTS

With reference to FIGS. 1 to 7A to 7C, an embodiment of a push button and a timepiece will be described.

The embodiment mentioned below will be described by taking, as an example, a case where the push button is a push button which is provided in a timepiece. However, the following embodiment does not limit the scope of the present invention to the following embodiment and the illustrated examples.

Figure 1:
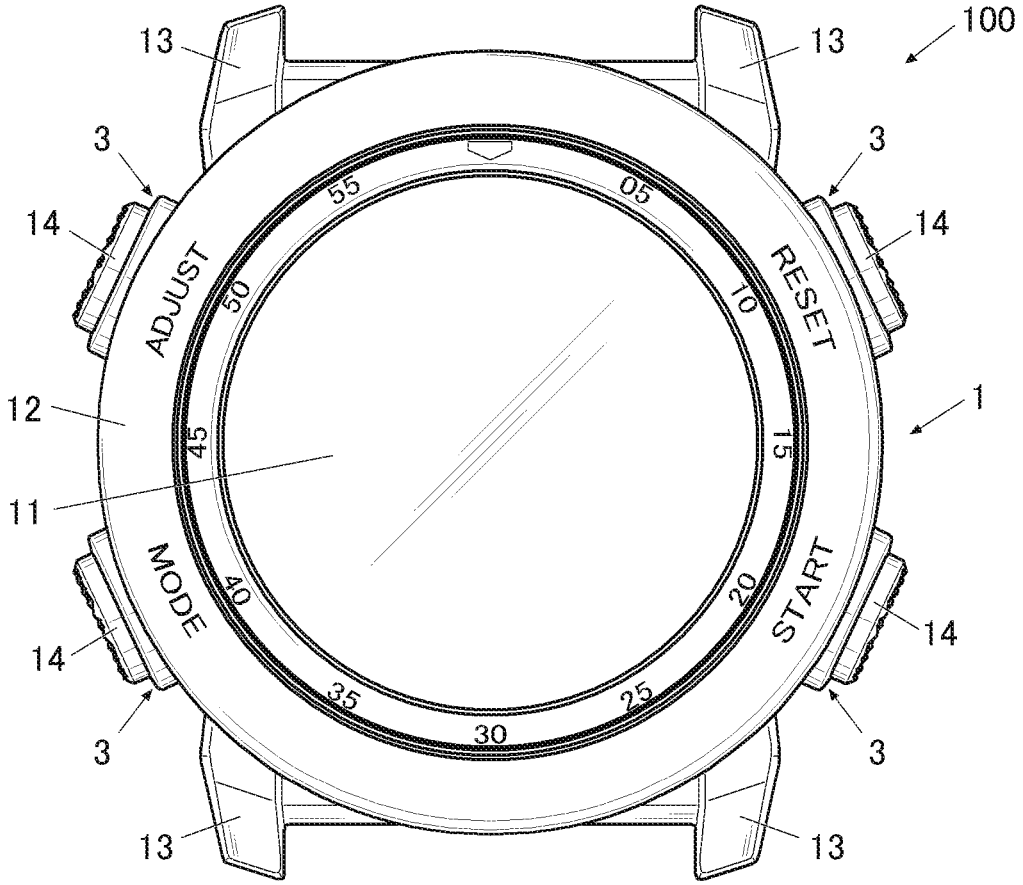
FIG. 1 is a front view of a timepiece which includes a push button in the embodiment.
Figure 2:
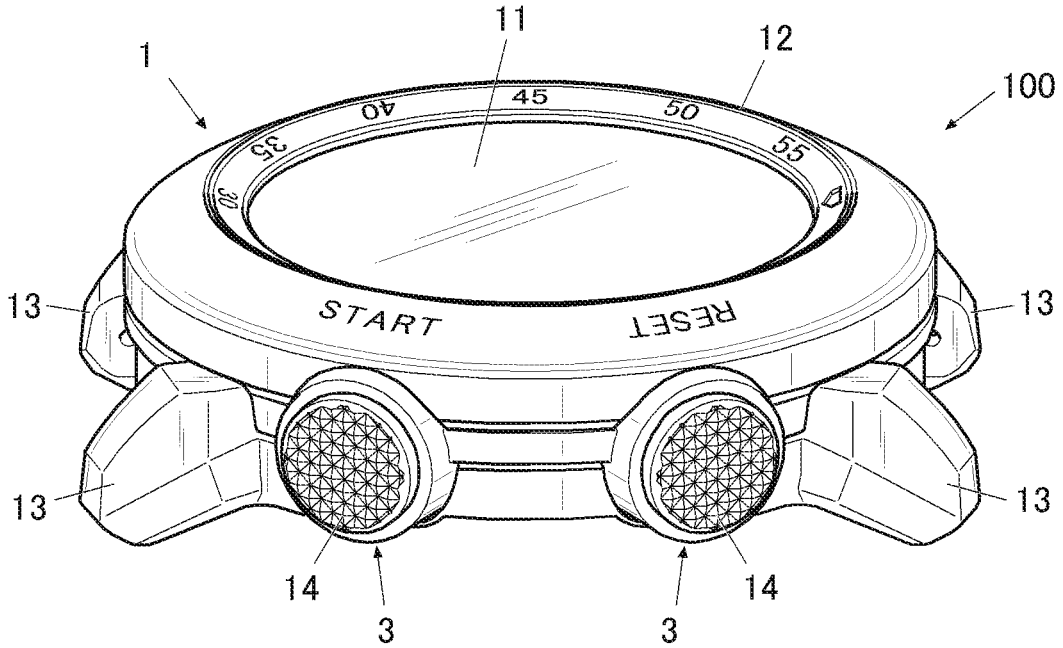
FIG. 2 is a perspective view of the timepiece shown in FIG. 1 seen from obliquely above the lateral portion.

FIG. 1 is a front view of the timepiece in the embodiment, and FIG. 2 is a perspective view of the timepiece shown in FIG. 1 seen from above the lateral portion.

In the embodiment, the timepiece 100 includes: a case 1; a timepiece module 2 arranged in the case 1 (module in the embodiment, see FIGS. 3 and 4); and push buttons 3.

The case 1 in the embodiment is a case of the back-cover integrated type (what is called one-piece structure) in which only the front surface side (visible side, upper side in FIG. 2) is open, and the back surface side (lower side in FIG. 2) is blocked.

The case 1 is formed of, for example, nylon resins such as Trogamid (registered trademark), ABS resins, synthetic resins such as super engineering plastics such as polyarylate (PAR) and engineering plastics such as polyacetal (POM) and polycarbonate (PC), ceramics, glasses, or metals such as titanium, stainless steel (SUS) and aluminum. The material forming the case 1 is not limited to the above examples.

A windshield member 11, which is formed of a transparent material such as clear glass to cover an opening portion, is provided to the opening on the front surface side (visible side, upper side) of the case 1. The windshield member 11 is attached to the case 1 via a waterproof ring not shown in the drawings. The windshield member 11 blocks the opening on the upper side of the case 1 while keeping the airtight state.

An exterior member 12 of a bezel or the like is provided on the front surface side of the case 1 to surround the windshield member 11. The shape and the like of the exterior member 12 are not limited to the illustrated example. The exterior member 12 may not be provided.

On 12 o'clock side and 6 o'clock side in the timepiece on the outer lateral surface of the case 1 (that is, at both ends on the upper and lower sides in FIG. 1), there are provided band attachment parts 13 to which timepiece band(s) (not shown in the drawings) can be attached.

On the lateral portion of the case 1, operation receiving members 14 forming push buttons 3 are provided.

In the embodiment, as shown in FIG. 1, four operation receiving members 14 are respectively arranged at left and right lateral portions corresponding to 2 o'clock, 4 o'clock, 8 o'clock and 10 o'clock positions in the timepiece.

The positions, number, specific shapes and the like of the operation receiving members 14 to be provided are appropriately set according to the design, the required function and the like of the timepiece 100, and thus not limited to the illustrated examples.

In each of the operation receiving members 14, one end thereof acts on a dynamic contact member 31 and thereby causes a movable contact part 315 to contact a fixed contact part 221. Each of the operation receiving members 14 has a shaft part 141 which is displaced by being pushed. One end side of the shaft part 141 is inserted into the case 1, and a button head part 142 is provided to the other end side of the shaft part 141.

In the embodiment, the operation receiving member 14 is shown to have the shaft part 141 as an example. However, the configuration of the operation receiving member 14 is not limited to this example. Since it is sufficient that the switch function can be executed by the displacement caused by pushing the button head part 142, the thickness and the shape of the shaft part 141 are not especially limited. In the embodiment, a case where the one end portion of the shaft part 141 directly pushes the dynamic contact member 31 is shown as an example. However, the shaft part 141 may indirectly act on the dynamic contact member 31.

In the embodiment, a button guard or the like for protecting the operation receiving member 14 is not provided around the button head part 142, and the button head part 142 protrudes from the outer lateral surface of the case 1.

A button pipe (not shown in the drawings), in which the shaft part 141 of each of the operation receiving members 14 is inserted, is provided to extend inside and outside the case 1 at the position corresponding to the operation receiving member 14 on the lateral portion of the case 1. By being inserted into the button pipe, the shaft part 141 is supported to be able to move smoothly along the shaft line direction, and protected from breakage or damage caused by an impact and the like.

A removal stopper ring 143 having an outer diameter larger than an inner diameter of the button pipe is attached to the portion which is one end portion of the shaft part 141 and inserted into the case 1 via the button pipe. The shaft part 141 (thus, the operation receiving member 14 including the shaft part 141) is prevented from coming out to the outside of the case 1 by the removal stopper ring 143. The removal stopper ring 143 is formed of a C ring or a washer of a circle plate, for example. The removal stopper ring 143 may be other than the C ring and the washer as long as the removal stopper ring 143 can prevent the removal of the shaft part 141.

The timepiece module 2 is formed by integrally incorporating a circuit board 22, a dial plate 23 and the like on front and back sides (upper and lower sides) of a main plate 21.

The main plate 21 is a substantially circular member formed of a relatively hard synthetic resin such as an engineering plastic and a super engineering plastic, for example.

Figure 3:
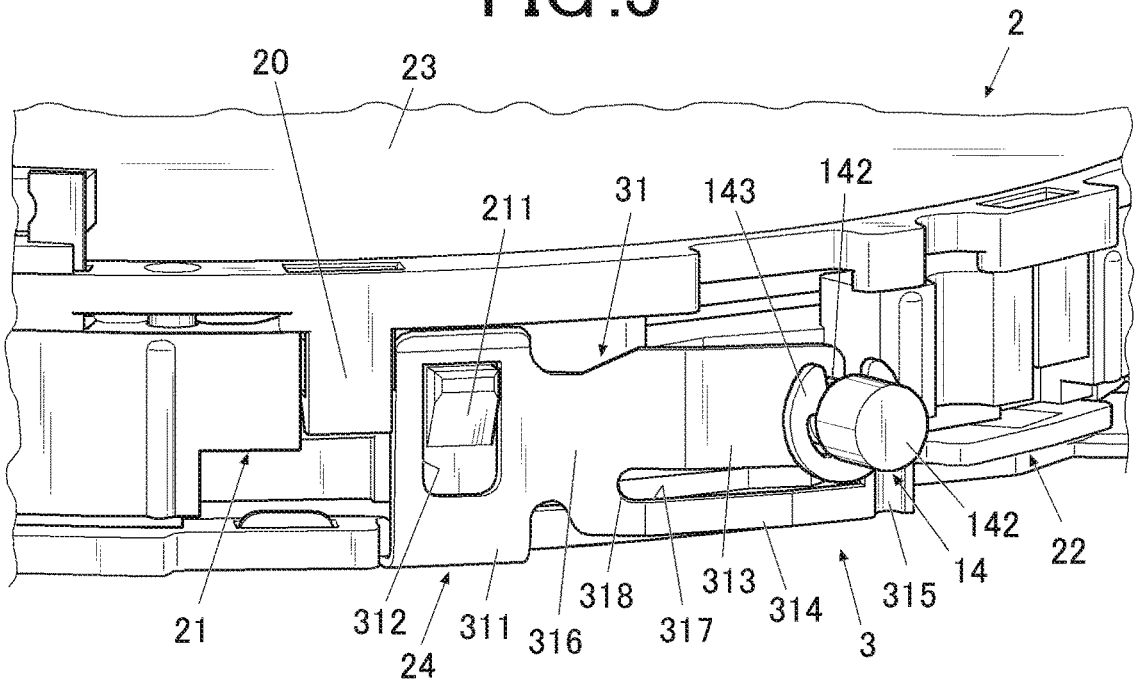
FIG. 3 is a main part perspective view of a timepiece module and an operation receiving member seen from obliquely above.
Figure 4:
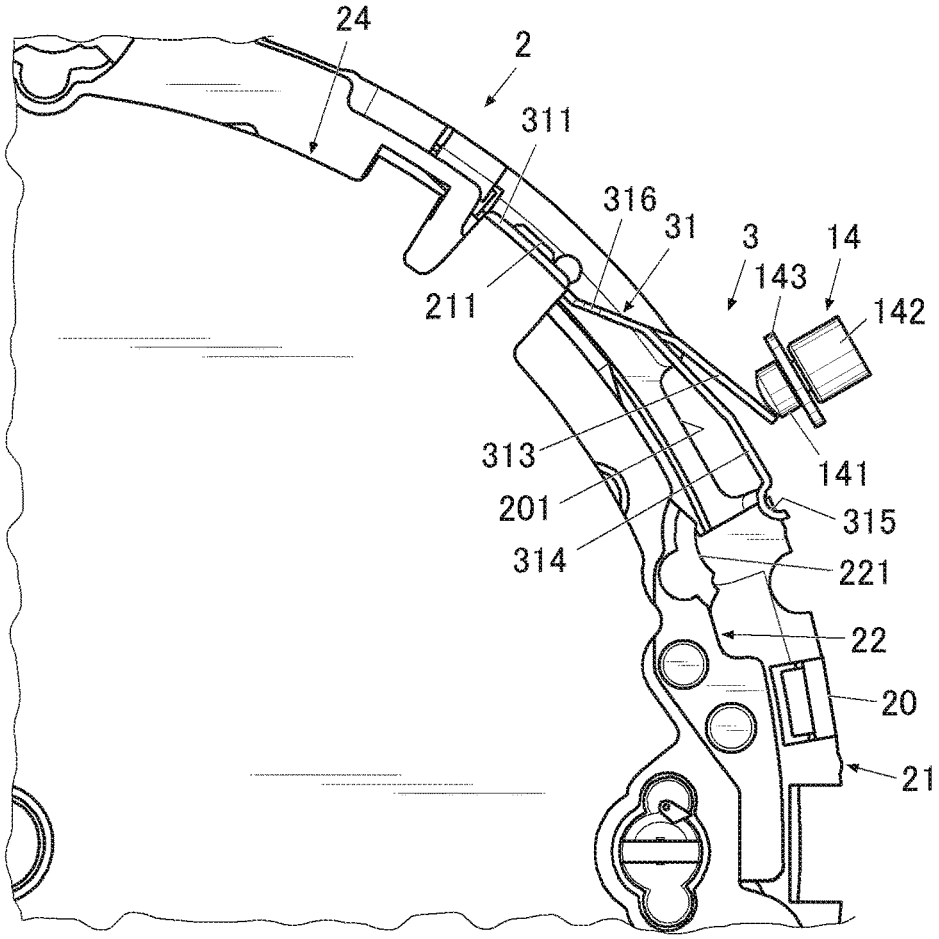
FIG. 4 is a main part plan view of the timepiece module and the operation receiving member seen from the back surface side.

FIG. 3 is a main part perspective view of the timepiece module and the operation receiving member seen from obliquely above (front surface side, visible side when the timepiece module is incorporated into the timepiece). FIG. 4 is a main part plan view of the timepiece module and the operation receiving member seen from the back surface side. Though the case 1 is actually arranged between the button head part 142 of the operation receiving member 14 and the timepiece module 2, the illustration of case 1 is omitted in FIGS. 3 and 4.

For example, as shown in FIGS. 3 and 4, the dial plate 23 is arranged on the front surface side (visible side, upper side in FIG. 3) of the main plate 21 in the timepiece module 2. Though not shown in the drawings, on the lower side of the dial plate 23 on the front surface of the main plate 21, for example, various function wheels such as a date wheel and a train wheel mechanism (gear mechanism) for operating hands in the analog type timepiece are arranged. In a case where the timepiece 100 is a digital type timepiece, or a timepiece including both of the analog type display part and the digital type display part, a liquid crystal display device or the like is also arranged on the front surface side of the main plate 21.

On the other hand, the circuit board 22 is arranged on the back surface side (lower side in FIG. 3) of the main plate 21. On the circuit board 22, various types of circuits and electrical conduction patterns (not shown in the drawings) are provided. The circuit board 22 is held from the lower side (back surface side) by the circuit pressing member 24, and incorporated into the main plate 21 by the circuit pressing member 24 being fixed to the main plate 21. Though not shown in the drawings, a driving mechanism such as a motor, various types of antenna devices and other various types of electronic components are arranged between the back surface of the main plate 21 and the circuit board 22. The battery (primary battery or secondary battery, not shown in the drawings) is also arranged appropriately on the back surface side of the main plate 21.

In the embodiment, fixed contact parts 221 are provided at respective positions corresponding to after-mentioned movable contact parts 315 of the push buttons 3 (that is, positions which the movable contact parts 315 can contact) on the lateral end surface of the circuit board 22.

Each of the fixed contact parts 221 is formed by performing processing (metallization processing) of forming a metal thin film on the end surface of the circuit board 22 or the like. The movable contact part 315 formed of a metal which has an electrical conductivity (for example, stainless steel material) electrically contacts the fixed contact part 221, and thereby the push button 3 is switched.

The circuit pressing member 24 is, for example, formed by performing a punching process, a bending process and the like to a plate which is made of a metal (for example, stainless steel material).

Figure 5:
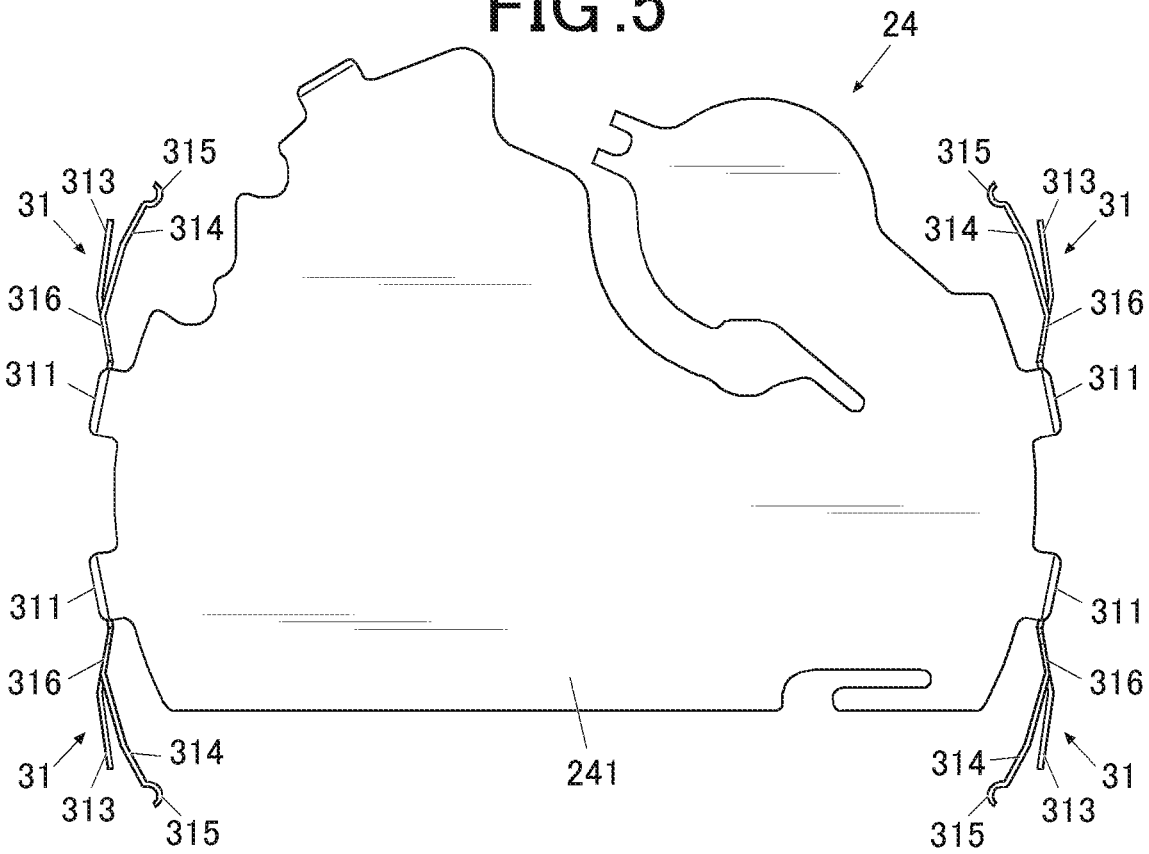
FIG. 5 is a plan view showing a circuit pressing member which has a dynamic contact member.
Figure 6:
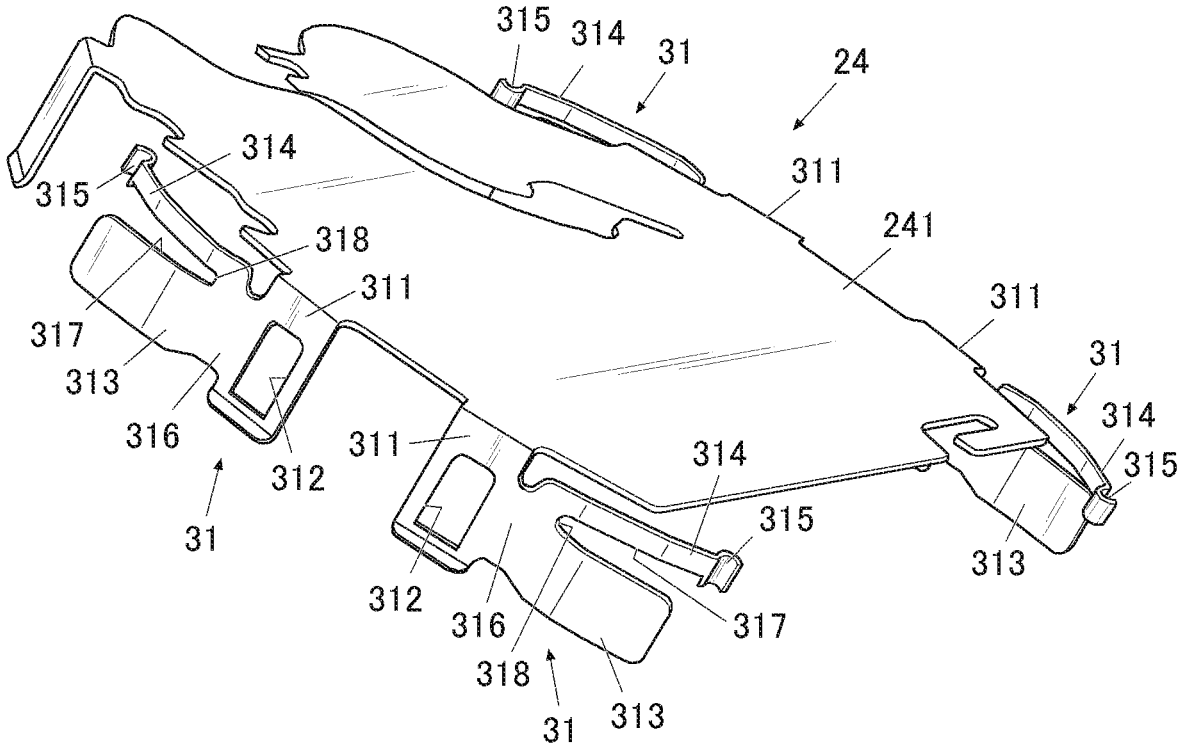
FIG. 6 is a perspective view of the circuit pressing member shown in FIG. 5.

In the embodiment, the circuit pressing member 24 includes a circuit pressing main body 241 formed to be a flat plate, and dynamic contact members 31 each of which is formed by being partially bend and raised toward the main plate 21 side (that is, upper side in FIG. 3) from the circuit pressing main body 241 (see FIGS. 5 and 6).

The dynamic contact member 31 is provided at each of four positions corresponding to the positions of operation receiving members 14 in the embodiment (that is, positions where the push buttons 3 are provided).

A part of the circuit pressing main body 241 may be a battery pressing part which presses the battery not shown in the drawings.

The push button 3 is configured by including the above-mentioned operation receiving member 14, the dynamic contact member 31, and a module (timepiece module 2) having the fixed contact part 221 which can contact and separate from the movable contact part 315. In the embodiment, as mentioned above, the dynamic contact member 31 forming the push button 3 is provided to the circuit pressing member 24. The dynamic contact member 31 is not limited to the case of being provided to the circuit pressing member 24. The dynamic contact member 31 may be any member as long as the movable contact part 315 is arranged at a position where the movable contact part 315 can contact the fixed contact part 221.

FIG. 5 is a plan view showing the circuit pressing member which has the dynamic contact members. FIG. 6 is a perspective view of the circuit pressing member.

Each of the dynamic contact members 31 is configured to be elastically deformable, and supported in a cantilever state with a base part 311 fixed. The dynamic contact member 31 is configured as a plate spring as a whole. As shown in FIGS. 3 to 6, the rising portion from the circuit pressing main body 241 provided to the circuit pressing main body 241 of the circuit pressing member 24 is the base part 311 of the dynamic contact member 31. A fastening hole 312 is formed in the base part 311.

The timepiece module 2 has a side wall 20 for fixing the base part 311. When the operation receiving member 14 acts on the dynamic contact member 31, in the dynamic contact member 31, an after-mentioned first movable part 313 and a second movable part 314 are displaced with the base part 311 fixed to the side wall 20 as a base point.

In the embodiment, tabs 211 are formed to protrude from the outer circumferential surface of the main plate 21, and the dynamic contact member 31 (thus, circuit pressing member 24 provided with the dynamic contact member 31) is attached to the main plate 21 by each of the tabs 211 being fixed to the fastening hole 312 of the base part 311.

In the dynamic contact member 31, there is provided the movable contact part 315 which can electrically contact the fixed contact part 221 provided to the circuit board 22 side.

The movable contact part 315 contacts the fixed contact part 221 by one end of the shaft part 141 of the operation receiving member 14 acting on the dynamic contact member 31. In the embodiment, the tip of the shaft part 141 presses the dynamic contact member 31 by the button head part 142 of the operation receiving member 14 being pushed in. Thus, the dynamic contact member 31 elastically deforms especially at the arm part 316 and is pressed toward the inside of the timepiece module 2, and the movable contact part 315 provided in the dynamic contact member 31 contacts the fixed contact part 221 provided in the circuit board 22.

In the embodiment, the arm part 316 is configured to be narrower than the width of the other portion and is easily displaced. The configuration of the arm part 316 is not limited to the example shown here. The arm part 316 may be formed to be thinner than the other portion or may be formed to be thinner and narrower than the other portion, for example, within the range of having a strength withstanding the twist and damage as long as the arm part 316 easily elastically deforms.

When the pushing operation of the button head part 142 is finished, the dynamic contact member 31 pushes back the shaft part 141 by the restoring force of spring, and returns to the initial position.

The movable contact part 315 in the dynamic contact member 31 is arranged at a position out of the line and its extended line, the line connecting the base part 311 and an acting portion 313*a* (see FIGS. 7A to 7C) where the shaft part 141 acts on the dynamic contact member 31.

In the embodiment, the dynamic contact member 31 has a first movable part 313 and a second movable part 314 having the common base part 311. The acting portion 313*a* which the shaft part 141 acts on (that is, presses) is arranged in the first movable part 313, and the movable contact part 315 is arranged in the second movable part 314.

The first movable part 313 and the second movable part 314 are connected to the base part 311 via the arm part 316 having the width narrower than the width of the base part 311 (width in the thickness direction of the timepiece module 2).

In the embodiment, as shown in FIG. 3 for example, the first movable part 313 has the width wider than the width of the second movable part 314. The first movable part 313 has the length shorter than the length of the second movable part 314, the length being a length in the longitudinal direction the base end of which is the base part 311.

The movable contact part 315 which is provided to the free end side of the second movable part 314 is formed to have the width a little larger than the entire width of the second movable part 314. A bending process is performed to the movable contact part 315 to protrude toward the fixed contact part 221. Thus, it is possible to make the movable contact part 315 more surely contact the fixed contact part 221, and thus the switching is stable.

Moreover, the plate thickness of the first movable part 313 is formed to be thicker than the plate thickness of the second movable part 314.

In such a way, the second movable part 314 is formed to have the width narrower than the width of the first movable part 313, and have the plate thickness thinner than the plate thickness of the first movable part 313. Thus, when the shaft part 141 acts on the acting portion 313*a* of the first movable part 313, it is possible to make the second movable part 314 easily displaced and make the movable contact part 315 more surely contact the fixed contact part 221, and thus the switching is stable.

The shape and the configuration of the dynamic contact member 31, the shapes and sizes of the first movable part 313 and the second movable part 314 and the like are not limited to the example shown here.

For example, the width of the first movable part 313 may be the same as the width of the second movable part 314. The plate thickness of the first movable part 313 may be the same as the plate thickness of the second movable part 314. In a case where the second movable part 314 is formed to have the plate thickness thinner than the plate thickness of the first movable part 313, the first movable part 313 and the second movable part 314 may have the same width, or the plate thickness of the second movable part 314 may be thinner than the plate thickness of the first movable part 313 while the width of the second movable part 314 is narrower than the width of the first movable part 313.

The specific configurations of the first movable part 313 and the second movable part 314 are set according to various types of conditions such as a material forming the shapes of the first movable part 313 and the second movable part 314.

In the embodiment, a slit 317 is formed between the first movable part 313 and the second movable part 314.

By providing the slit 317, the first movable part 313 and the second movable part 314 are separated.

As mentioned above, the first movable part 313 and the second movable part 314 have the common base part 311 (in the embodiment, base part 311 and arm part 316). Thus, even though the first movable part 313 and the second movable part 314 are separated by the slit 317, when the first movable part 313 is pressed by the shaft part 141, the second movable part 314 is also moved in the pressing direction (that is, the acting direction of the shaft part 141) in conjunction with this pressing of the first movable part 313.

Though the shape, width and the like of the slit 317 are not especially limited, in the embodiment, the slit 317 is a gap of approximately 0.5 mm provided between the first movable part 313 and the second movable part 314. The shape, size and the like of the slit 317 are not limited to the example shown here.

The slit 317 is open toward the other end side from the base part 311 side, and a curved surface part 318 is formed on the base part 311 side (base end side) of the slit 317. Thus, the entire slit 317 is in a nearly U-shape.

The size and the shape of the curved surface part 318 are not limited to the illustrated example. However, securing a sufficient curved surface part 318 is preferable since a crack or split is not easily generated in the portion where the first movable part 313 and the second movable part 314 diverge (that is, the base end portion of the slit 317), and the durability is excellent.

From the same viewpoint of avoiding easy generation of the crack and split in the dynamic contact member 31 and improving the durability, it is preferable to provide a curved surface to the corner portions such as the inside of the fastening hole 312 provided on each base part 311 and the surrounding portions of each arm part 316, not only to the base portion of each slit 317. FIG. 3 shows the embodiment in which the curved surface is provided to each of the portions as an example.

In the embodiment, the second movable part 314 is located to be shifted from the first movable part 313 in the acting direction of the shaft part 141.

That is, as shown in FIG. 5, the dynamic contact member 31 is in a gentle curve along the outer shape of the timepiece module 2 from the arm part 316 to the first movable part 313 and the second movable part 314. However, the second movable part 314 is largely curved to the inner side than the first movable part 313 (direction approaching the lateral end surface of the circuit board 22) so that the movable contact part 315 easily contacts the fixed contact part 221. In addition, when the timepiece module 2 is housed in the case 1, the second movable part 314 including the movable contact part 315 does not easily interfere with the internal lateral surface or the like of the case 1, and thus it is possible to prevent the damage.

Though the curved amount of each of the first movable part 313 and the second movable part 314 is not especially limited, the curved amount is set according to the size, configuration and the like of the push button 3 and the equipment into which the push button 3 is incorporated (in the embodiment, timepiece 100).

For example, the distance from the first movable part 313 having the acting portion 313*a* to the lateral end surface of the circuit board 22 is preferably set to be longer than the pushing possible amount and the stroke amount of the operation receiving member 14. The pushing possible amount of the operation receiving member 14 in the embodiment is, for example, approximately 1.0 mm. Thus, it is preferable to perform a bending process to the first movable part 313 to a degree of separating from the lateral end surface of the circuit board 22 by 1.0 mm or more.

Thus, even in a case where the operation receiving member 14 is pushed to the limit of stroke, the first movable part 313 does not contact the lateral end surface of the circuit board 22, and it is possible to prevent the damage of the circuit board 22 and the like.

In the embodiment, at the position corresponding to the acting portion 313*a* on the lateral surface of the timepiece module 2, there is provided a contact avoiding part 201 having a depth deeper than the depth of the position when the acting portion 313*a* is displaced to the maximum in the acting direction. Thus, in the embodiment, it is possible to more surely avoid contact between the first movable part 313 and the circuit board 22, and the like.

The second movable part 314 having the movable contact part 315 needs to make the movable contact part 315 surely contact the fixed contact part 221. Thus, the distance from the movable contact part 315 to the fixed contact part 221 needs to be set to be equal to or shorter than the distance at which the second movable part 314 moves in conjunction with the first movable part 313 when the shaft part 141 acts on the acting portion 313*a* of the first movable part 313 (that is, when the acting portion 313*a* is pressed by the shaft part 141 of the operation receiving member 14).

For example, in a case where the limit stroke amount of the operation receiving member 14 is 1.0 mm and the movement amount of second movable part 314 in conjunction with the first movable part 313 is approximately half the movement amount of the first movable part 313, it is preferable to perform a bending process to the second movable part 314 so that the second movable part 314 is arranged at the distance within approximately 0.4 mm from the lateral end surface of the circuit board 22.

Thus, when the operation receiving member 14 is pushed by approximately 80% of the limit stroke amount, it is possible to make the movable contact part 315 surely contact the fixed contact part 221, and surely perform switching.

Next, the action of the push buttons 3 and the timepiece 100 including the push buttons 3 in the embodiment will be described with reference to FIGS. 7A to 7C.

In the embodiment, in a case of forming the timepiece 100 including the push buttons 3, the shaft parts 141 of operation receiving members 14 are respectively inserted into the button pipes which are provided at four positions in the lateral portions of the case 1, and the removal stopper rings 143 are mounted near the tips of the shaft parts 141 inserted in the case 1. The timepiece module 2 is housed from the opening portion on the visible side (front surface side) in the case 1.

When the timepiece module 2 is housed, the direction and the like of the dial plate are adjusted, and especially in the embodiment, positioning is performed to arrange the first movable parts 313 of the four dynamic contact members 31 provided in the circuit pressing member 24 at the positions corresponding to the shaft parts 141 of the operation receiving members 14.

Thus, by pushing the button head part 142 of any operation receiving member 14, the tip of the shaft part 141 can press the acting portion 313*a* of the first movable part 313.

In the embodiment, as mentioned above, a bending process is performed to the second movable part 314 having the movable contact part 315 to be along around the outer circumference of the circuit board 22 of the timepiece module 2. Thus, when the timepiece module 2 is housed in the case 1, the second movable part 314 does not get caught on the inner circumferential surface of the case 1 or the like, and it is possible to house the timepiece module 2 in the case 1 smoothly without damaging the movable contact part 315 or the like.

When the arrangement of the timepiece module 2 and the like in the case 1 is completed, the windshield member 11 is attached via the waterproof ring so as to block the opening on the visible side (front surface side) of the case 1. The exterior member 12 is mounted so as to surround the windshield member 11.

Then, the assembly of the push buttons 3 and the timepiece 100 including the push buttons 3 is completed.

Figure 7A:
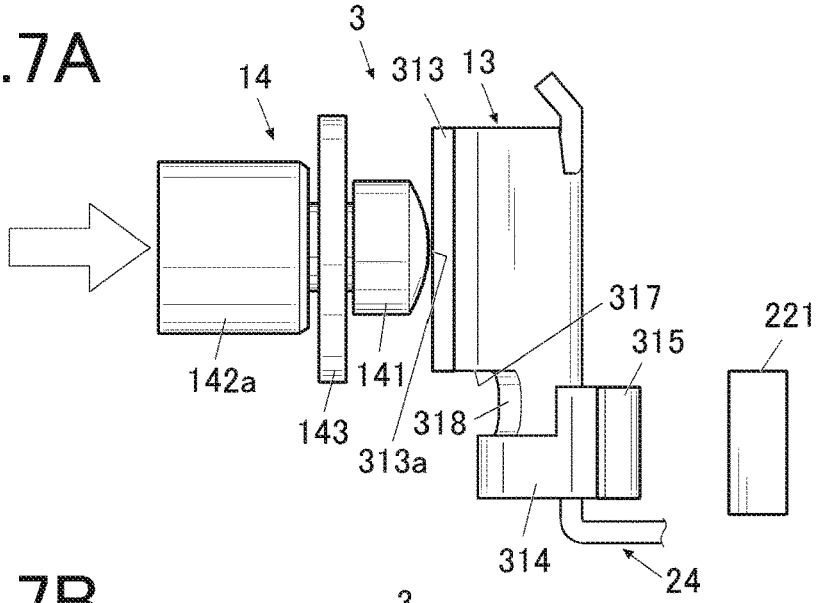
FIG. 7A is a view schematically showing how a movable contact part contacts a fixed contact part by an operation to the operation receiving member.
Figure 7B:
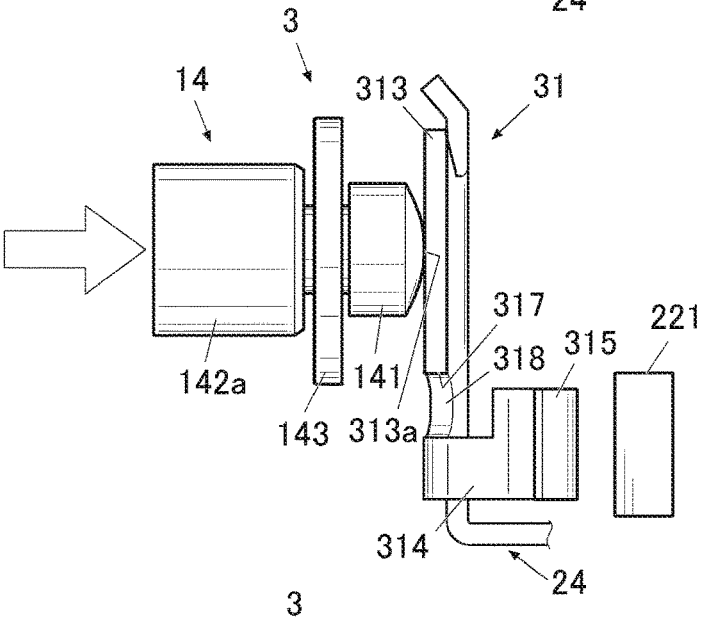
FIG. 7B is a view schematically showing how the movable contact part contacts the fixed contact part by the operation to the operation receiving member.
Figure 7C:
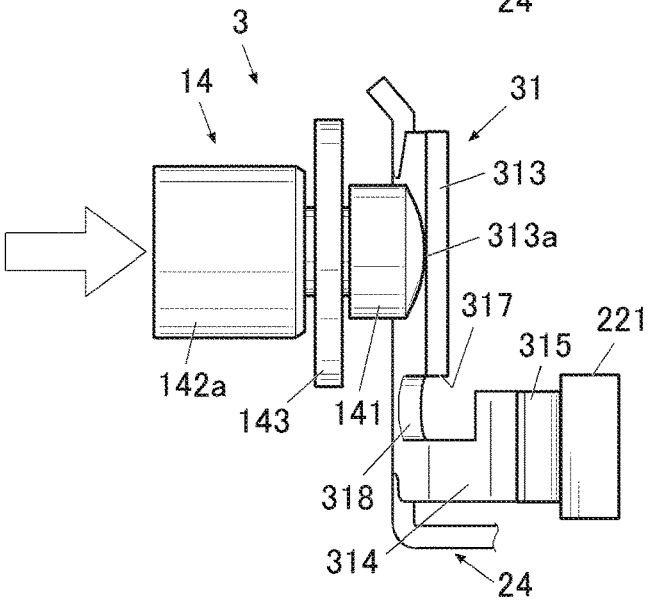
FIG. 7C is a view schematically showing how the movable contact part contacts the fixed contact part by the operation to the operation receiving member.

FIGS. 7A to 7C are explanation views schematically showing how the movable contact part of the dynamic contact member contacts the fixed contact part of the circuit board by the operation performed to the operation receiving member. FIGS. 7A to 7C show, with white arrows, the acting direction (pressing direction) in which the shaft part 141 of the operation receiving member 14 which is an operation member acts (presses).

In the embodiment, as shown in FIG. 7A, the portion which the shaft part 141 of the operation receiving member 14 acts on (presses) is the acting portion 313*a* of the first movable part 313.

When the operation receiving member 14 is pushed in in the acting direction, the tip of the shaft part 141 contacts the acting portion 313*a* of the first movable part 313, and moves the first movable part 313 of the dynamic contact member 31 in the acting direction.

When the first movable part 313 moves, the second movable part 314 separated from the first movable part 313 with the slit 317 also gradually moves in the acting direction in conjunction with the first movable part 313 as shown in FIG. 7B. At this time, for example, when the first movable part 313 moves by 1, the second movable part 314 moves by approximately 0.5 in conjunction with the first movable part 313.

That is, the second movable part 314 moves in conjunction with the first movable part 313, but the movement amount of the second movable part 314 is smaller than the movement amount of the first movable part 313 on which the shaft part 141 is directly acting (pressing).

When the operation receiving member 14 is pushed in by the limit stroke amount or the amount which is a little less than the limit stroke amount, as shown in FIG. 7C, the first movable part 313 does not reach the position (that is, position on the lateral end surface of the circuit board 22) where the fixed contact part 221 is provided. However, the movable contact part 315 of the second movable part 314 contacts the fixed contact part 221, and is electrically connected with the fixed contact part 221. Thus, the push button 3 is switched, and various types of functions assigned to this push button 3 are achieved.

In such a way, in the embodiment, the position (acting portion 313*a*) on which the shaft part 141 of the operation receiving member 14 acts in the push button 3 is separated from the movable contact part 315 which contacts the fixed contact part 221 for switching of the push button 3, and the movable contact part 315 does not directly receive the influence of the force received by the acting portion 313*a*. When the shaft part 141 acts on the acting portion 313*a*, the movable contact part 315 also moves, but the movement amount of the movable contact part 315 is smaller than the movement amount of the acting portion 313*a*.

Thus, even in a case where the operation receiving member 14 is pushed in by the limit stroke amount or the amount exceeding the limit stroke amount, and in a case where a strong impact is applied from outside, the strong impact is not applied to the fixed contact part 221 which contacts the movable contact part 315 or the circuit board 22 on which the fixed contact part 221 is provided, and furthermore, the strong impact is not applied to the timepiece module 2.

Thus, in the embodiment, the push buttons 3 and the timepiece 100 in which the push buttons 3 are incorporated have a high impact resistance, and can withstand the impact due to the fall of the timepiece 100 and the like without additionally providing any cushioning member or the like around the operation receiving members 14 (button head parts 142).

As described above, according to the embodiment, the push button 3 includes: a timepiece module 2 which has a fixed contact part 221; a dynamic contact member 31 which is configured to be elastically deformable, supported in a cantilever state with a base part 311 being fixed, and has a movable contact part 315 that can contact and separate from the fixed contact part 221; and an operation receiving member 14 which has a shaft part 141 making the movable contact part 315 contact the fixed contact part 221 by the one end of the shaft part 141 acting on the dynamic contact member 31. The movable contact part 315 in the dynamic contact member 31 is arranged at a position out of a line and the extended line of the line, the line connecting the base part 311 and the acting portion 313*a* where the shaft part 141 acts on the dynamic contact member 31.

In such a way, since the acting portion 313*a* on which the shaft part 141 acts and the movable contact part 315 are separated from each other in the push button 3, the movable contact part 315 does not directly receive the influence of the force received by the acting portion 313*a*.

Thus, even in a case where a strong impact or the like is applied to the button head part 142 or the like, it is possible to prevent the large impact or stimulation from being applied to the movable contact part 315, the fixed contact part 221 which contacts the movable contact part 315, the circuit board 22, and the timepiece module 2. Thus, it is possible to achieve the push button 3 which is excellent in the impact resistance that can prevent the damage or malfunction of parts of the devices and the equipment (timepiece 100) into which the devices are incorporated.

In the embodiment, the dynamic contact member 31 includes: the base part 311 fixed to the main plate 21; and the first movable part 313 and the second movable part 314 which shares the base part 311. The acting portion 313*a* is arranged in the first movable part 313 and the movable contact part 315 is arranged in the second movable part 314.

Thus, even in a case where an impact is applied to the acting portion 313*a*, it is possible to prevent the impact from being applied to the movable contact part 315, the fixed contact part 221 which contacts the movable contact part 315, the circuit board 22, the timepiece module 2 and the like. Moreover, it is possible to surely perform switching of the push button 3 by making the second movable part 314 move in conjunction with the first movable part 313.

In the embodiment, the slit 317 is formed between the first movable part 313 and the second movable part 314.

Thus, it is possible to more surely separate the movable contact part 315 and the acting portion 313*a* on which the shaft part 141 acts from each other. Even in a case where an impact is applied to the acting portion 313*a*, it is possible to surely prevent the impact from being applied to the movable contact part 315, the fixed contact part 221 which contacts the movable contact part 315, the circuit board 22, the timepiece module 2 and the like.

In the embodiment, the slit 317 is open toward the other end side from the base part 311 side, and the curved surface part 318 is formed on the base part 311 side.

A large stress is applied to the base end portion of the slit 317 which separates the first movable part 313 from the second movable part 314, and the crack, split and the like are easily generated.

With respect to this point, by providing a curved surface in the base end portion of the slit 317 as in the embodiment, the generation of crack, split and the like are prevented, and the dynamic contact member 31 is not easily damaged.

In the embodiment, the second movable part 314 is located to be shifted from the first movable part 313 in the acting direction (arrow direction in FIG. 7A) of the shaft part 141.

In such a way, in a case where the second movable part 314 is located to be shifted from the first movable part 313 in the acting direction of the shaft part 141 and arranged on the inner side of the timepiece module 2 than the first movable part 313, it is possible to make the movable contact part 315 more surely contact the fixed contact part 221. Moreover, when the timepiece module 2 is housed in the case 1, the second movable part 314 does not easily interfere with the inner circumferential surface or the like of the case 1, and even if the second movable part 314 has a narrow shape or the like, the damage does not easily occur.

In a case where the timepiece 100 includes the push button 3 in the embodiment, since the impact resistance is excellent, the damage does not easily occur even without protecting the portion protruding outside of the case 1 such as the button head part 142 of the operation receiving member 14 forming the push button 3.

Thus, it is not necessary to cover the button head part 142 and the like with the cushioning member or the like, the clean appearance configuration can be adopted, and the timepiece 100 not having the restriction of design or the like and being excellent in design can be achieved.

As in the embodiment, in a case where the second movable part 314 is shifted from the first movable part 313 in the acting direction of the shaft part 141 and arranged on the inner side of the timepiece module 2 than the first movable part 313, it is possible to make the movable contact part 315 more surely contact the fixed contact part 221. Moreover, when the timepiece module 2 is housed in the case 1, the second movable part 314 does not easily interfere with the inner circumferential surface or the like of the case 1, and even if the second movable part 314 has a narrow shape or the like, the damage does not easily occur.

Though the embodiment has been described, the present invention is not limited to the embodiment, and various modifications can be made within the scope of the present invention.

For example, the specific shape of the dynamic contact member 31 is not limited to the example shown in the embodiment as long as the movable contact part 315 is arranged at a position out of the line connecting the acting portion 313*a* and the base part 311 and its extended line.

Figure 8:
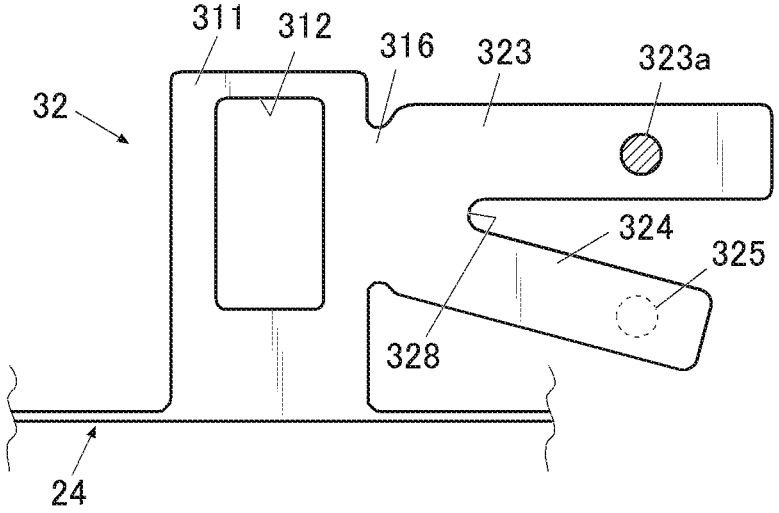
FIG. 8 is a schematic plan view showing a modification example of the dynamic contact member.
Figure 9:
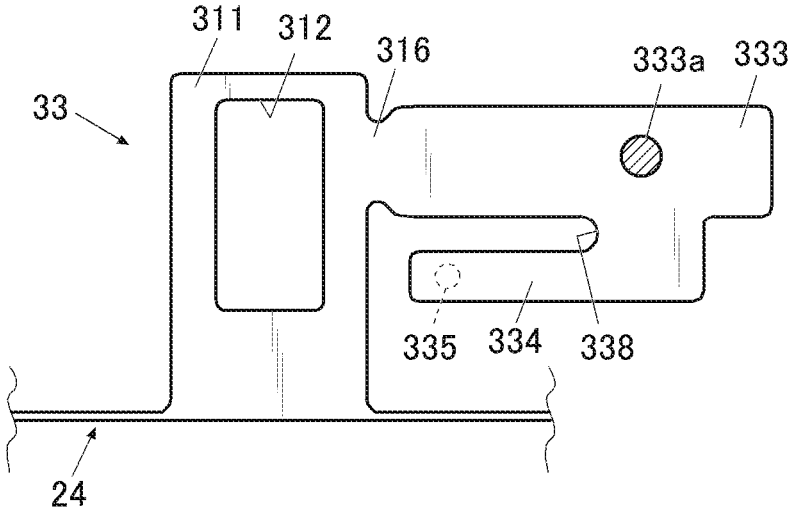
FIG. 9 is a schematic plan view showing a modification example of the dynamic contact member.
Figure 10:
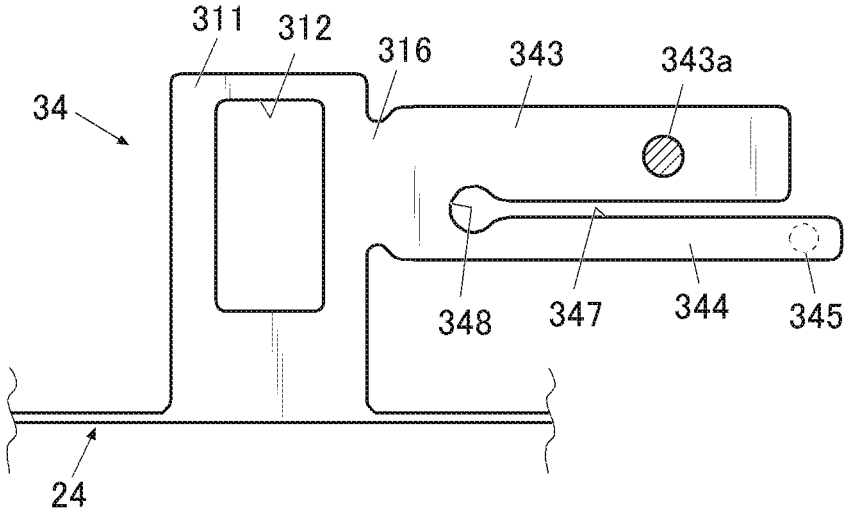
FIG. 10 is a schematic plan view showing a modification example of the dynamic contact member.

FIGS. 8 to 10 are views schematically showing modification examples of the dynamic contact member.

The explanation of parts similar to the parts in the embodiment is omitted by providing same reference numerals.

The dynamic contact member 32 shown in FIG. 8 includes a first movable part 323 extending in a horizontal direction (horizontal direction in FIG. 8) from the base part 311 and a second movable part 324 extending obliquely downward from the base part 311, and the first movable part 323 and the second movable part 324 are arranged in a nearly V shape. A curved surface part 328 is provided at a portion where the first movable part 323 and the second movable part 324 diverge.

In the dynamic contact member 32, the movable contact part 325 indicated by the dashed line is arranged at a position out of the line connecting the acting portion 323*a* indicated by hatching of oblique lines and the base part 311 and its extended line.

Also in this case, the external force applied to the acting portion 323*a* does not directly influence the movable contact part 325, and it is possible to prevent the damage of the fixed contact part 221 which contacts the movable contact part 325, the circuit board 22, the timepiece module 2 and the like.

The dynamic contact member 33 shown in FIG. 9 includes a first movable part 333 extending in the horizontal direction (horizontal direction in FIG. 9) from the base part 311 and a second movable part 334 diverging from the first movable part 333 and extending in the direction of returning to the base part 311 side. A curved surface part 338 is formed at the turnaround portion of the second movable part 334 diverging from the first movable part 333.

In the dynamic contact member 33, the movable contact part 335 indicated by the dashed line is arranged at a position out of the line connecting the acting portion 333*a* indicated by hatching of oblique lines and the base part 311 and its extended line.

Also in this case, the external force applied to the acting portion 333*a* does not directly influence the movable contact part 335, and it is possible to prevent the damage of the fixed contact part 221 which contacts the movable contact part 335, the circuit board 22, the timepiece module 2 and the like.

The dynamic contact member 31 is not limited to the member formed by the punching process and the bending process of the metal plate, and may be formed by etching, for example.

In a case where minute processes can be performed to the dynamic contact member 31, the slit portion may be narrowed further.

In this case, for example, as shown in FIG. 10, a narrow slit 347 is provided between a first movable part 343 and a second movable part 344 of the dynamic contact member 34 and a curved surface part 348 is provided at the base end portion of the slit 347 where the first movable part 343 and the second movable part 344 diverge.

Also in this case, in the dynamic contact member 34, the movable contact part 345 indicated by the dashed line is arranged at a position out of the line connecting the acting portion 343*a* indicated by hatching of oblique lines and the base part 311 and its extended line.

In the case of making the slit 347 narrow, it is preferable to make the curved surface part 348 in a shape close to a circle so that it is possible to secure as large curved surface as possible. By making the slit 347 narrow, a larger stress is applied to the base end portion of the slit 347. However, by making the curved surface part 348 in the shape shown in FIG. 10, it is possible to ease the stress applied to the base end portion of the slit 347 and prevent the damage such as crack and split from being easily generated.

A slit in a shape close to the circle may be applied to the curved surface part 318 and the like of the slit 317 in the embodiment.

As shown in FIG. 10, by increasing the lengths of the first movable part 343 and the second movable part 344 and providing the acting portion 343*a* and the movable contact part 345 at the portions away from the base part 311, there can be expected an effect of further preventing the movable contact part 345 from receiving the influence such as the impact due to the pressing on the acting portion 343*a*.

It is not essential to provide a slit between the first movable part and the second movable part of the dynamic contact member.

For example, in a case where the dynamic contact member is formed of a material which does not easily generate the crack or split, only a simple cut may be provided without providing the slit between the first movable part and the second movable part.

The embodiment has been described by taking, as an example, a case where the second movable part of the dynamic contact member is arranged at a position shifted from the position of the first movable part in the acting direction of the shaft part 141. However, it is not essential to shift the position in the acting direction of the second movable part from the position of the first movable part.

For example, in a case where the conjunction property of the second movable part with respect to the first movable part is low due to the thickness of the dynamic contact member, the flexibility of the material or the like, the first movable part and the second movable part may be configured to be located at nearly same positions in the acting direction of the shaft part 141 (that is, the positions where the first movable part 313 and the second movable part 314 are nearly flush with each other in FIGS. 4 and 5).

Also in this case, in the dynamic contact member, by arranging the movable contact part at a position out of the line connecting the acting portion and the base part and its extended line, the external force applied to the acting portion does not directly influence the movable contact part, and it is possible to prevent the damage of the fixed contact part 221 which contacts the movable contact part, the circuit board 22, the timepiece module 2 and the like.

Furthermore, in the embodiment, the dynamic contact member 31 is provided with the arm part 316 which has a narrow width and a thin thickness so as to elastically deform more easily than the other portion. However, the configuration and the like of the arm part 316 are not limited to the example shown in the embodiment. For example, the shape and the like of the arm part 316 are not limited to the illustrated example, and the arm part 316 may have a shape without a narrow portion and only the thickness may be thin. The arm part 316 may not be provided depending on the material and the like forming the dynamic contact member.

The embodiment has been described by taking, as an example, a case where the case 1 is a case of the back cover-integrated type which is open only on the visible side. However, the configuration of the case is not limited to this. For example, the case 1 may be a cylindrical frame body which is open on upper and lower sides (upper and lower sides in FIG. 2, visible side and back surface side in timepiece 100).

The embodiment has been described by taking, as an example, a case where the push button 3 is applied to the timepiece 100. However, the present invention is not limited to a case where the push button is applied to the timepiece.

For example, the push button of the present invention may be applied to other various types of electronic equipment such as a pedometer, a heart rate meter, an altimeter, and a barometer.

In the embodiment, the tip shape of the shaft part 141 is illustrated as a round shape as an example. However, the present invention is not limited to this, and the tip of the shaft part 141 may have a different shape such as a rectangular shape. By having a shape of increasing the contact area between the shaft tip and the acting portion 313*a*, it is possible to reduce the influence of twist generated in the first movable part 313.

Although several embodiments have been described, the scope of the present invention is not limited to the above described embodiments and includes the scope of the present invention that is described in the claims and the equivalents thereof.

What is claimed is:

1. A push button comprising:

a module comprising a fixed contact part;

an operation receiving member comprising one end configured to be moved; and a dynamic contact member comprising:

a base part fixed to the module;

a first movable arm having a first end connected to the base part and a second end supported by the first end of the first movable arm in a cantilever state, wherein the first movable arm comprises an action portion arranged closer to the second end of the first movable arm than the first end of the first movable arm, and wherein the action portion is arranged relative to the operation receiving member to receive a force from the one end of the operation receiving member to elastically deform the first movable arm that is connected to the base part in the cantilever state; and a second movable arm having a connected end connected to the first movable arm and a free end that does not contact the first movable arm, wherein the second movable arm comprises a movable contact part arranged closer to the free end of the second movable arm than the connected end of the second movable arm, wherein a portion of the second movable arm having the free end and the movable contact part curves more towards the module than the first movable arm, and wherein the second movable arm is configured to be moved by elastic deformation of the first movable arm to bring the movable contact part into electrical contact which is electrically contactable with the fixed contact part of the module.

2. A timepiece comprising the push button according to claim 1.

3. The push button according to claim 1, wherein the first movable arm is formed to have a width wider than a width of the second movable arm.

4. The push button according to claim 1, wherein the first movable arm is formed to have a plate thickness thicker than a plate thickness of the second movable arm.

5. The push button according to claim 1, wherein the operation receiving member comprises a shaft configured to be displaced by pressing to move the one end of the operation receiving member, and wherein the action portion of the first movable arm is configured to receive the force from the one end of the operation receiving member moved by displacement of the shaft to elastically deform the first movable arm that is connected to the base part in the cantilever state to move the second movable arm connected to the first movable arm to bring the movable contact part into electrical contact with the fixed contact part.

6. The push button according to claim 1, wherein the module comprises a side wall, and wherein the base part of the dynamic contact member is fixed to the side wall of the module.

7. The push button according to claim 1, wherein the acting portion of the first movable arm is configured to be displaced by the force from the one end of the operation receiving member in an acting direction toward the module, and wherein the acting portion of the first movable arm is configured to not contact the module when the acting portion is displaced to a maximum in the acting direction.

8. The push button according to claim 1, wherein the acting portion of the first movable arm is configured to be displaced by the force from the one end of the operation receiving member in an acting direction toward the module, and wherein the second movable arm is configured to be moved by the first movable arm in the acting direction.

9. The push button according to claim 1, wherein a slit is formed between the first movable arm and the second movable arm.

10. The push button according to claim 9, wherein the slit opens from a base part side closer to the first end of the first movable arm than the second end of the first movable arm toward the second end of the first movable arm to separate the free end of the second movable arm from the first movable arm, and wherein a curved surface is formed on the base part side.

* * * * *